US006599416B2

(12) United States Patent
Kool et al.

(10) Patent No.: US 6,599,416 B2
(45) Date of Patent: Jul. 29, 2003

(54) METHOD AND APPARATUS FOR SELECTIVELY REMOVING COATINGS FROM SUBSTRATES

(75) Inventors: Lawrence Bernard Kool, Clifton Park, NY (US); Ralph James Carl, Jr., Clifton Park, NY (US); Bin Wei, Mechanicville, NY (US); James Anthony Ruud, Delmar, NY (US); Mark Alan Rosenzweig, Hamilton, OH (US); Stephen Joseph Ferrigno, Cincinnati, OH (US)

(73) Assignee: General Electric Company, Niskayuna, NY (US)

( * ) Notice: Subject to any disclaimer, the term of this patent is extended or adjusted under 35 U.S.C. 154(b) by 113 days.

(21) Appl. No.: 09/682,620

(22) Filed: Sep. 28, 2001

(65) Prior Publication Data

US 2003/0062271 A1 Apr. 3, 2003

(51) Int. Cl.[7] ..... C25F 5/00; C25F 7/00

(52) U.S. Cl. ..... 205/717; 205/722; 205/723; 204/224 M; 204/267; 204/272

(58) Field of Search ..... 205/717, 723, 205/722; 204/224 M, 267, 272

(56) References Cited

U.S. PATENT DOCUMENTS

| | | | | |
|---|---|---|---|---|
| 3,607,398 | A | 9/1971 | Lucas | |
| 3,622,391 | A | 11/1971 | Baldi | |
| 3,779,879 | A | 12/1973 | Scott | |
| 4,327,134 | A | 4/1982 | Baldi | |
| 4,678,552 | A | 7/1987 | Chen | |
| 4,851,093 | A | 7/1989 | Routsis | |
| 5,801,217 | A | 9/1998 | Rodzewich et al. | |
| 5,976,265 | A | 11/1999 | Sangeeta et al. | |
| 6,042,880 | A | 3/2000 | Rigney et al. | |
| 6,352,636 | B1 * | 3/2002 | Wei et al. | 205/717 |

FOREIGN PATENT DOCUMENTS

| | | |
|---|---|---|
| EP | 0242583 | 6/1990 |
| EP | 1010782 | 6/2000 |
| EP | 1013787 | 6/2000 |
| GB | 2026038 A | 1/1980 |

OTHER PUBLICATIONS

Copending patent application Ser. No. 09/420,059, filed Oct. 18, 1999, by Bin Wei et al., entitled "Electrochemical System and Process for Stripping Metallic Coatings". 6,352,636.

Copending patent application Ser. No. 09/591,531, filed Jun. 9, 2000, by L.B. Kook et al., entitled "A Method for Removing a Coating from a Substrate, and Related Compositions".

Copending patent application Ser. No. 09/771,186, filed Jan. 29, 2001, by L.B. Kool et al., entitled "A Method for Removing Oxides and Coatings from a Substrate".

* cited by examiner

*Primary Examiner*—Arun S. Phasge
(74) *Attorney, Agent, or Firm*—Noreen C. Johnson; Christian G. Cabou

(57) ABSTRACT

An electrochemical stripping method for selectively removing at least one coating from the surface of a substrate is described. The substrate is immersed in an aqueous composition through which electrical current flows. The composition includes an acid having the formula $H_xAF_6$, in which "A" is Si, Ge, Ti, Zr, Al, or Ga; and x is 1–6. Various coatings can be removed, such as diffusion or overlay coatings. The method can be used to fully-strip a coating (e.g., from a turbine component), or to partially strip one sublayer of the coating. Related processes and an apparatus are also described.

46 Claims, 10 Drawing Sheets

METHOD AND APPARATUS FOR SELECTIVELY REMOVING COATINGS FROM SUBSTRATES

BACKGROUND OF INVENTION

This invention generally relates to electrochemical methods for removing at least one metallic coating from a substrate. In some of the more specific embodiments, the invention is directed to methods for selectively stripping aluminum-containing coatings from metal substrates.

A variety of coatings are used to provide oxidation resistance and thermal barrier properties to metal articles, such as turbine engine components. Current coatings used on components in gas turbine hot sections, such as blades, nozzles, combustors, and transition pieces, generally belong to one of two classes: diffusion coatings or overlay coatings. State-of-the-art diffusion coatings are generally formed of aluminide-type alloys, such as nickel-aluminide, platinum-aluminide, or nickel-platinum-aluminide.

Overlay coatings typically have the composition MCrAl (X), where M is an element from the group consisting of Ni, Co, Fe, and combinations thereof, and X is an element from the group consisting of Y, Ta, Si, Hf, Ti, Zr, B, C, and combinations thereof. Diffusion coatings are formed by depositing constituent components of the coating, and reacting those components with elements from the underlying substrate, to form the coating by high temperature diffusion. In contrast, overlay coatings are generally deposited intact, without reaction with the underlying substrate.

When articles such as gas turbines are serviced, the protective coatings usually must be removed to permit inspection and possible repair of the underlying substrate, followed by re-coating. Removal of the coatings is typically carried out by immersing the component in a stripping solution. A variety of stripping techniques are currently available for removing different types of coatings from metal substrates. The techniques usually must exhibit a considerable amount of selectivity. In other words, they must remove only intended materials, while generally preserving the article's desired structures.

In the case of metallic coatings like those based on aluminum, one example of a particular stripping technique is chemical etching. In such a process, the article is submerged in an aqueous chemical etchant. The metallic coating on the article surface is then dissolved as a result of reaction with the etchant.

While many stripping techniques are very useful for a variety of applications, they may not always include the features needed in specialized situations. As an example, many forms of chemical etching are generally nonselective, and can result in undesirable loss of the substrate material. This material loss can lead to changes in critical dimensions, e.g., turbine airfoil wall thickness or cooling hole diameter. The material loss can also lead to structural degradation of the substrate alloy, e.g., by way of intergranular attack. Moreover, chemical etching can result in the stripping of coatings from internal passages in the article, which is often undesirable.

Masking techniques can be used to protect portions of a component's structure from the effects of stripping solutions. For example, masking is often used to protect the internal cooling passages and holes in turbine engine components. However, masking and the subsequent removal of the masks can be time- and labor-consuming, detracting from the efficiency of a repair process.

Electrochemical stripping processes overcome some of the disadvantages inherent in conventional techniques such as chemical etching. For example, a patent application filed on Oct. 15, 1999 for Bin Wei et al, Ser. No. 09/420,059, describes a very useful electrochemical stripping process. In general, the process selectively removes metallic coatings from the external sections of a metallic article, such as a turbine component. The process employs an electrolytic solution based on various compounds, such as organic and inorganic salt/solvent systems. Examples of electrolytic systems are ammonium chloride/ethylene glycol, and aqueous sodium chloride. An advantage of this type of process is that coatings on internal passageways of the component generally remain unaffected by the action of the stripping agent—even when they have not been masked.

The invention of patent application Ser. No. 09/420,059 possesses novel features which are very useful for some applications. However, additional improvements are desirable in other situations. For example, ammonium chloride-type electrolytes can sometimes damage the base metal of an article. Moreover, sodium chloride-based electrolytes may not provide the "throwing power" sometimes required to strip articles which have complex shapes. Furthermore, the use of sodium chloride and some of the other inorganic salts can require specialized equipment, such as electrodes with highly conformal geometries. This requirement can add to the overall cost of the stripping process.

Moreover, some of the electrochemical stripping processes do not provide a wide enough "process window" for efficient commercial operation. For example, the time period between complete stripping of the coating and the occurrence of significant damage to the substrate may be too short.

The need for a significant process window can be especially important in the case of aluminum-based diffusion coatings for metal substrates. Such coatings usually include two regions or "sublayers": an additive sublayer which lies on top of the base metal, and a diffusion sublayer below the additive sublayer, which is incorporated into the upper region of the base metal. Repeated stripping and re-applications of these coatings necessitate repeated removal of the diffusion sublayer, which can undesirably decrease the thickness of the substrate, e.g., a turbine airfoil. Thus, it is often desirable to remove only the additive sublayer when repairing the component, without significantly removing the diffusion sublayer. In this situation, stripping processes which do not slow down or cease after the additive sublayer has been removed are often impractical in an industrial setting.

It should thus be apparent that new stripping processes for removing coatings from substrates would be welcome in the art. The processes should include the advantageous features of known stripping techniques, while avoiding at least some of their deficiencies. For example, the new processes should be capable of removing substantially all of a given coating material, while not substantially attacking the substrate. The processes should also minimize or completely eliminate the need for masking. They should also preserve the structural and dimensional integrity of the parent alloy, as well as internal passages and cooling holes which may be located within an article (e.g., a turbine component).

Ideally, the new stripping processes would also include additional processing advantages. For example, they should not result in the formation of an unacceptable amount of hazardous fumes in the workplace, or effluent which cannot easily be treated. Moreover, the processes should include process windows (e.g., between the time when coating layers are removed but other layers and the substrate are preserved) which provide flexibility and efficiency in a large-scale treatment facility.

SUMMARY OF INVENTION

A primary embodiment of this invention is directed to an electrochemical stripping method for selectively removing at least one coating from the surface of a substrate. The substrate is often a superalloy material, e.g., a turbine engine component. The method includes the step of immersing the substrate in an aqueous composition through which electrical current flows. The composition comprises an acid having the formula $H_xAF_6$, or precursors to said acid. "A" is Si, Ge, Ti, Zr, Al, or Ga; and x is 1–6. Various coatings can be removed, such as diffusion coatings (e.g., aluminide-based) or overlay coatings of the MCrAl(X)-type. As used herein, the term "removal of a coating" is meant to refer to the severe degradation of the coating, leaving (at most) only a coating residue which weakly adheres to the underlying surface. The residue is easily removed by a subsequent, conventional technique such as "de-smutting", as discussed below.

The method of this invention can be used in a "full strip" operation, where an entire coating is removed, or in a "partial strip" operation. In the latter case, only one portion of a coating is removed. For example, the additive sublayer of a diffusion coating can be removed effectively and completely, while retaining the diffusion sublayer, as further described below. The electrical cell potential within the aqueous composition is adjusted to maximize the efficiency and selectivity of the process.

Another embodiment of the invention is directed to a method for replacing a worn or damaged protective coating applied over a substrate. The coating to be replaced is electrochemically removed by the process described below, i.e., using the $H_xAF_6$, electrolyte. A new coating can then be applied by any appropriate technique, e.g., aluminiding processes, high velocity oxy-fuel (HVOF), plasma spray, physical vapor deposition, and the like. As also described below, this embodiment is especially useful in the case of repairs for diffusion-aluminide coatings applied to substrates having rigorous dimensional requirements.

Still another embodiment of this invention relates to an apparatus for the electrochemical removal of at least one coating from a substrate. Features of the apparatus are described in detail below. In brief, it includes: (a) an electrolyte which comprises an acid having the formula $H_xAF_6$, as described herein; (b) an electrical current source capable of being connected to the coated substrate (i.e., the anode) and an electrode (i.e., the cathode); and (c) at least one electrode from which the electrical current source can apply electrical current through the electrolyte to the coated substrate.

The electrolyte for the apparatus is usually incorporated into a stripping bath in which the coated substrate can be immersed.

Further details regarding the various features of this invention are found in the remainder of the specification.

DETAILED DESCRIPTION

Figure 1:
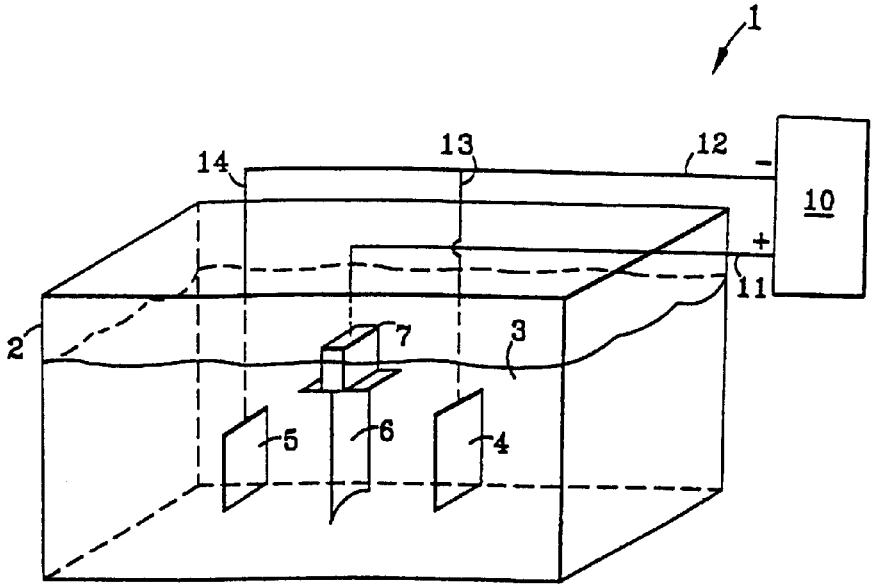
FIG. 1 is a schematic illustration of an electrochemical stripping system.

As mentioned previously, the electrochemical stripping system and process of this invention employs an acidic electrolyte ("acid") having the formula $H_xAF_6$. In this formula, A is selected from the group consisting of Si, Ge, Ti, Zr, Al, and Ga. The subscript "x" is a quantity from 1 to 6, and more typically, from 1 to 3. Materials of this type are available commercially, or can be prepared without undue effort. The preferred acids are $H_2SiF_6$ or $H_2ZrF_6$. In some embodiments, $H_2SiF_6$ is especially preferred. The last-mentioned material is referred to by various names, such as "hydrofluosilicic acid", "fluorosilicic acid", "hexafluorosilicic acid", and "HFS".

Precursors to the $H_xAF_6$ acid may also be used. As used herein, a "precursor" refers to any compound or group of compounds which can be combined to form the acid or its dianion $AF_6^{-2}AF_6^{-2}$, or which can be transformed into the acid or its dianion under reactive conditions, e.g. the action of heat, agitation, catalysts, and the like. Thus, the acid can be formed in situ in a reaction vessel, for example.

As one illustration, the precursor may sometimes be a metal salt, inorganic salt, or an organic salt in which the dianion is ionically bound. Non-limiting examples include salts of Ag, Na, Ni, and K, as well as organic salts, such as a quaternary ammonium salt. Dissociation of the salts in an aqueous solution often yields the acid. In the case of $H_2SiF_6$, a convenient salt which can be employed is $N_2SiF_6$.

Those skilled in the art are familiar with the use of compounds which cause the formation of $H_xAF_6$ within an aqueous composition. For example, $H_2SiF_6$ can be formed in situ by the reaction of a silicon-containing compound with a fluorine-containing compound. An exemplary silicon-containing compound is $SiO_2$, while an exemplary fluorine-containing compound is hydrofluoric acid (i.e., aqueous hydrogen fluoride).

The preferred level of $H_xAF_6$ acid which is employed will depend on various factors. They include the type and amount of coating being removed; the location of the coating material on a substrate; the type of substrate; the thermal history of the substrate and coating (e.g., the level of interdiffusion); the time and temperature used for treatment; and the stability of the acid in the treatment solution. Moreover, other factors related to the electrochemical stripping system may also influence how much of the $H_xAF_6$ acid should be used. Those factors (e.g., electrical power levels) are discussed below.

As a general rule, the $H_xAF_6$ acid is present in a treatment composition at a level in the range of about 0.05 M to about 5 M, where M represents molarity. (Molarity can be readily translated into weight or volume percentages, for ease in preparing the solutions.). Usually, the level is in the range of about 0.2 M to about 3.5 M. In the case of $H_2SiF_6$, a preferred concentration range is often in the range of about 0.2 M to about 2.2 M. Adjustment of the amount of $H_xAF_6$ acid, and of other components described below, can readily be made by considering stoichiometric parameters, and by observing the effect of particular compositions on coating removal from the substrate.

The aqueous composition used for the present invention may include various other additives which serve a variety of functions. Non-limiting examples of these additives are inhibitors, dispersants, surfactants, chelating agents, wetting agents, deflocculants, stabilizers, anti-settling agents, and anti-foam agents. Those of ordinary skill in the art are familiar with specific types of such additives, and with effective levels for their use. An example of an inhibitor for the composition is a relatively weak acid like acetic acid, mentioned above. Such a material tends to lower the activity of the primary acid in the composition. This is desirable in some instances, e.g., to decrease the possibility of pitting the substrate surface.

Many different types of substrates may be treated according to the present invention. Usually, the substrate is metallic. Non-limiting examples of metallic materials are those which comprise at least one element selected from the group consisting of iron, cobalt, nickel, aluminum, chromium, titanium, and mixtures which include any of the foregoing (e.g., stainless steel).

Very often, the metallic material is a superalloy. Such materials are known for high-temperature performance, in terms of tensile strength, creep resistance, oxidation resistance, and corrosion resistance, for example. The superalloy is typically nickel-, cobalt-, or iron-based, although nickel- and cobalt-based alloys are favored for high-performance applications. The base element, typically nickel or cobalt, is the single greatest element in the superalloy by weight. Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel, Nimonic, Rene (e.g., Rene80-, Rene95, Rene142, and ReneN5 alloys), and Udimet, and include directionally solidified and single crystal superalloys. Illustrative cobalt-base superalloys include at least about 30 wt % Co, and at least one component from the group consisting of nickel, chromium, aluminum, tungsten, molybdenum, titanium, and iron. Examples of cobalt-base superalloys are designated by the trade names Haynes, Nozzaloy, Stellite and Ultimet.

The coating that is removed from the substrate by this invention is generally a diffusion coating or an overlay coating, as mentioned above. Diffusion coatings are typically formed of aluminide-type materials, which are well-known in the art. Such materials are sometimes modified with a noble metal, such as platinum or palladium. Non-limiting examples include aluminide, platinum-aluminide, nickel-aluminide, platinum-nickel-aluminide, and mixtures thereof.

Overlay coatings were also described above. They usually have the composition MCrAl(X), where M is an element selected from the group consisting of Ni, Co, Fe, and combinations thereof; and X is an element selected from the group consisting of Y, Ta, Si, Hf, Ti, Zr, B, C, and combinations thereof. Methods for forming and applying both types of coatings are known in the art.

The thickness of a diffusion coating or an overlay coating will depend on various factors, such as the type of article being coated, the composition of the substrate, and the environmental conditions to which the article will be subjected. In the case of metal-based substrates such as superalloys, an MCrAl(X)-type coating will often have an average thickness of about 50 microns to about 500 microns. An aluminide-based coating for such a substrate will often have an average thickness of about 5 microns to about 125 microns. (Approximate thicknesses for diffusion coating sublayers are discussed below.) A variety of electrochemical stripping systems may be used for the present invention. One suitable apparatus is described in the above-referenced patent application Ser. No. 09/420,059, which is incorporated herein by reference. FIG. 1 schematically illustrates such a system 1, which includes an electrolyte bath receptacle 2.

The bath contains electrolyte 3, e.g., an aqueous solution of the $H_xAF_6$, along with one or more of the other additives described previously.

The electrolyte bath receptacle 2 (sometimes referred to herein as the "receptacle") is formed of any suitable material which is non-reactive with any of the bath components. The shape and capacity of the receptacle 2 may vary according to the application, as long as the receptacle is sized sufficiently to accommodate the electrodes and electrolyte 3. The electrochemical stripping system of this invention includes at least one electrode. Two electrodes are depicted in FIG. 1. The number of electrodes will vary, depending on various factors, such as the size and shape of the article being treated.

Each electrode, 4 and 5, is formed with an appropriate geometry that is configured to direct electrical fields to the surfaces of the coated article 6. As described in patent application Ser. No. 09/420,059, appropriate geometric configurations for the electrodes include, but are not limited to, planar geometries, cylindrical geometries, and combinations thereof. Each electrode could have a complex, geometric shape, e.g., one that is approximately complementary to the geometry of the article 6 that is to be stripped (see FIG. 2).

However, the effectiveness of the electrolyte described herein usually obviates having electrodes shaped in this manner. The electrodes 4 and 5 are generally non-consumable and remain intact throughout the electrochemical stripping process.

The article 6, which is to be stripped by the electrochemical stripping system 1, is disposed in the receptacle 2. The article is at least partially covered with one or more of the coatings described previously. The article 6 is disposed between the electrodes 4 and 5, and positioned so that an electric field can be established between the electrodes and the selected coated surfaces of the article. The electrolyte 3 is delivered to the receptacle 2 in amounts sufficient to submerge parts of the article 6 and electrodes 4 and 5. If a portion 7 of the article, e.g., a dovetail section of a turbine component, does not require stripping, this portion may be kept above the level of the electrolyte 2. Alternatively, this portion 7 can be physically masked so as to shield the electric field. A further alternative is to minimize the electric field over this portion of the component surface, for example, by modifying the electrode location. The portions of the article 6 that are to be electrochemically stripped should be submerged in the electrolyte 3.

Figure 4:
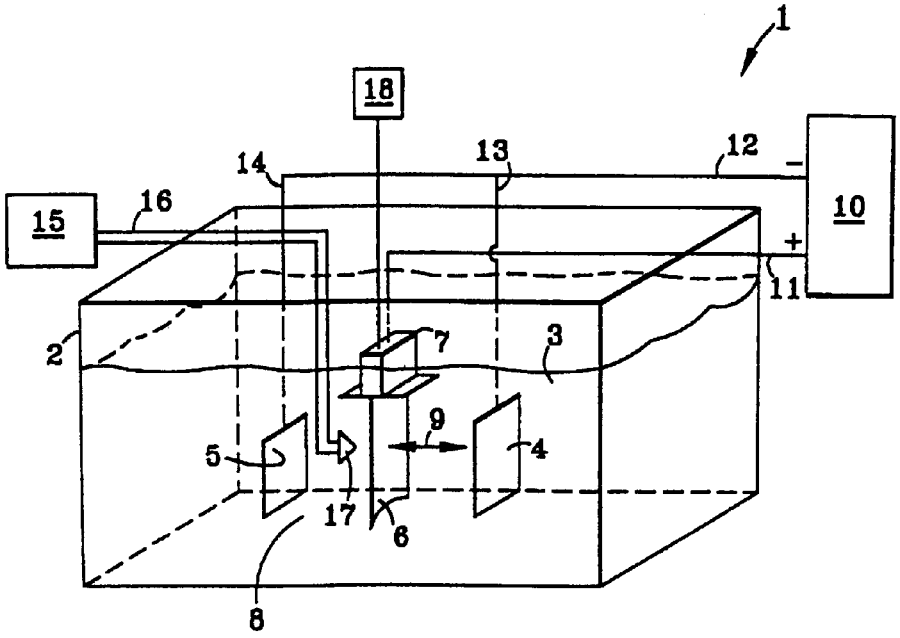
FIG. 4 is a schematic illustration of another electrochemical stripping system.

The electrolyte 3 can be delivered into the receptacle 2 by any appropriate means. For example, and in no way limiting of the invention, the electrolyte may be poured into the receptacle 2. Alternatively, the electrolyte 2 can be delivered into the receptacle 2 by a pumping device, as shown in FIG. 4. The pumping device 15 is connected to the receptacle 2 via a conduit 16. The conduit 16 extends to a gap 8 that is disposed between the article 6 and one of the electrodes 4 or 5. The pumping device 15 can comprise a low-pressure pump, which agitates and stirs electrolyte 3 in the receptacle 2. For example, ejection of the electrolyte 3 from a nozzle 17 of the pumping device 15 can cause agitation and stirring of the electrolyte 3 in the receptacle 2.

Alternatively, the article 6 can be moved, reciprocally or rotated about its own or a displaced axis by an appropriate support 11, as illustrated by arrow 9 (FIG. 4). The article 6 can be moved by an appropriate motive device 18 in the electrolyte 3, such as but not limited to, at least one of mechanical and magnetic devices. The movement of the electrolyte 3 accelerates Joule heat dissipation and helps maintain a homogeneous electrolyte composition during the electrochemical stripping process. Excessive heat or local changes in electrolyte chemistry may alter the stripping reaction, for example, but not limited to, hindering and slowing reaction times, increasing reaction rates, or increasing parent alloy attack.

A power supply 10 establishes an electric field in the electrochemical stripping system 1 (see FIG. 1). The power supply is usually (but not always) direct current (DC), with a switching-mode capability. It is often operated in the constant potential mode. Power supply 10 carries current over connections 12, 13, and 14, to the electrodes 4 and 5. The electrodes, 4 and 5, are connected to the negative terminals of the power supply 10. The stripping of the coating from article 6 comprises the electrolyte reacting with the coating. The electrolyte carries charge to article 6, and under the action of the electric current, the coating is stripped from the article. Removal of the current halts the electrochemical stripping process.

Various parameters define the stripping characteristics for the present invention. These parameters influence the rate of material removal and thus, the efficiency of the stripping process. Non-limiting, exemplary parameters are: electrode geometry, power supply voltage or current (dependent on parameters being controlled), electrolyte concentrations, solvent composition, use of agitation, processing time, distance between the article and electrodes, and electrolyte temperature. Those who are familiar with electrochemical machining techniques would be familiar with many of the stripping parameters which relate to the present invention.

The stripping parameters may vary over operational ranges. For example, a DC power supply voltage may vary from a trace voltage (the term "trace" means a small but measurable value) to about 30V. The electrical current is sometimes pulsed, to allow charged ionic byproducts to leave the electrode boundary layers. However, pulsed power application is not critical for the present invention. The distance between the article 6 and an electrode typically varies in a range from about 0.1 inch (0.25 cm) to about 10 inches (25.4 cm).

One important parameter for carrying out the present invention is the electrochemical cell potential. (This term is sometimes referred to herein as "voltage", "potential", or "electrical potential", unless otherwise specified). In carrying out the process, an electrical potential is applied across the electrodes to cause current to flow between the electrodes and the article being treated. With reference to the system of FIG. 1, the cell potential is measured between article 6 and electrodes 4 and 5. (The measurement is taken in solution, as close as possible to the anode (the article) and the cathode (the electrodes)).

The present inventors have discovered that, while employing the electrolyte described herein, they can readily adjust or "tune" the cell potential to achieve a highly-selective full strip or partial strip, as described below. (As those skilled in the art understand, the cell potential can also be measured relative to a reference electrode, e.g., relative to a standard electrochemical reaction. Many references describe these concepts, e.g., Chemistry—The Central Science, by T. Brown and H. E. LeMay, Jr., Prentice-Hall, Inc, 1977).

Figure 5:
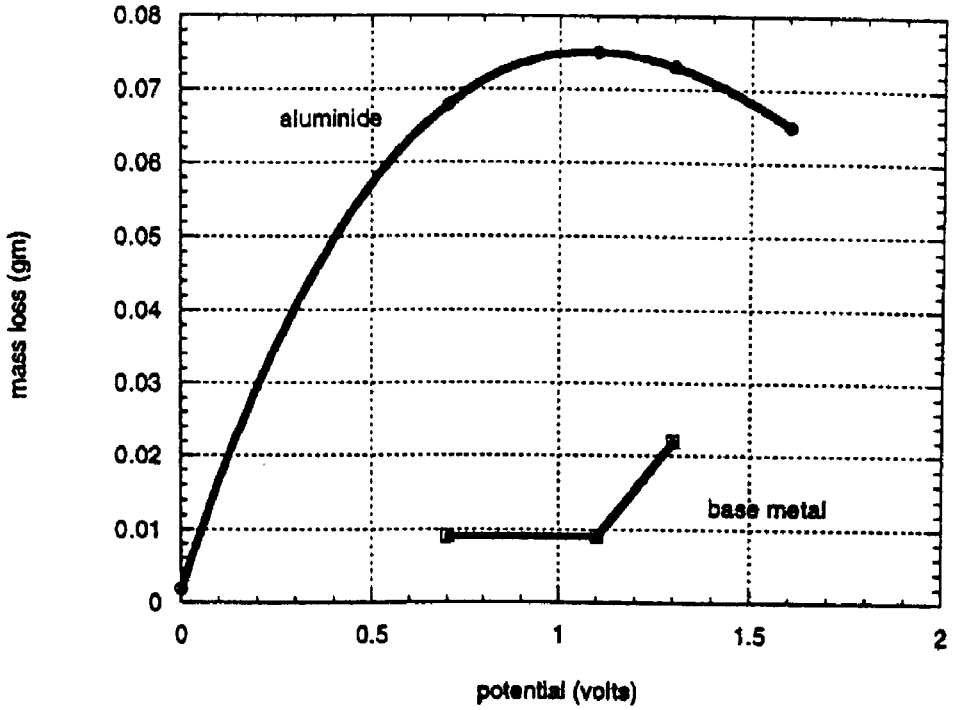
FIG. 5 is plot of mass-loss for the material of an additive layer, as a function of electrical potential, for coating systems treated by the present invention.

FIG. 5 represents a plot of mass-loss as a function of electrical cell potential. The coating in this instance was platinum aluminide. The substrate was a nickel-based superalloy, in the form of a flat button coupon. (Two coupons were tested one with the coating, and one without it). An electrochemical stripping apparatus similar to that of FIG. 1 was used, and the electrolyte was 10% $H_2SiF_6$. Power was supplied to the system at a constant, direct current (no pulse). The figure depicts mass loss for the aluminide material and the substrate (base metal) after 10 minutes of immersion in the stripping bath.

At a cell potential of about 1.1 volts, the coating was removed at a very fast rate. (Note that the "aluminide" curve represents mass loss for the additive sublayer of the coating). Of special note is the fact that the coating was being removed at a rate which was about eight times greater than the rate at which the base metal was being removed. At a potential above 1.1 volts, the rate of coating removal slowed, and was only about twice as fast as removal of the substrate material. Clearly, then, an optimum range for voltage, i.e., cell potential, can be ascertained for a particular electrochemical striping system being employed.

The most appropriate range of voltage for a given embodiment will depend on many of the other stripping parameters described herein. In general, the voltage should be high enough to remove the entire coating, but low enough to avoid significant removal of the base metal of the substrate. As a non-limiting example, the selected voltage when removing an aluminide-based coating from a metal substrate is often in the range of about 0.9 volt to about 1.3 volts.

Figure 6:
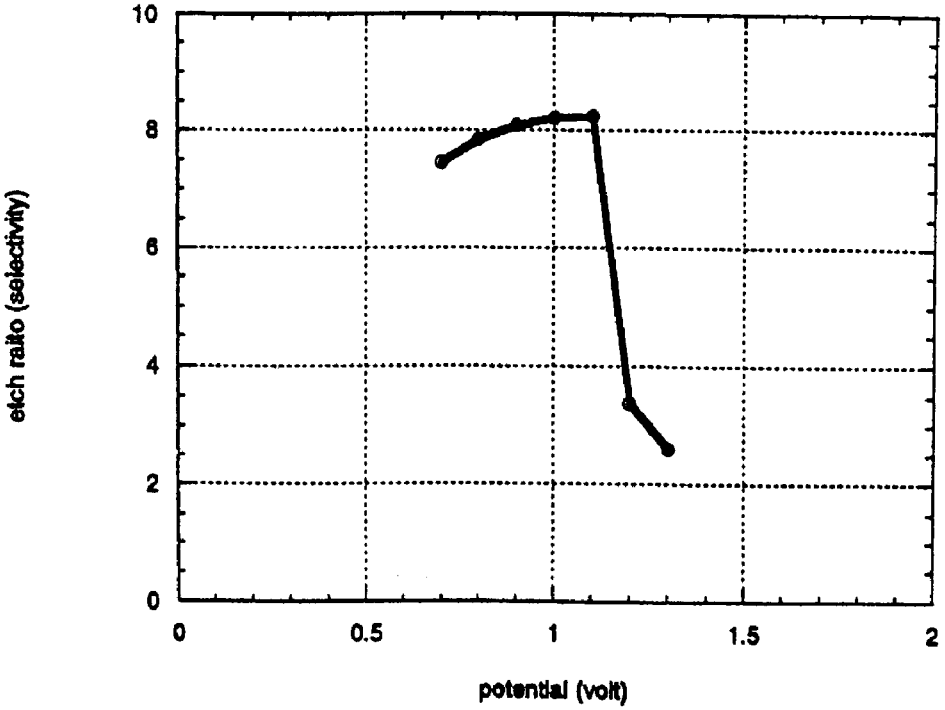
FIG. 6 is a plot of etching ratio as a function of electrical potential, for coating systems treated by the present invention.

It should be emphasized that the presently-claimed process can be efficiently carried out over a relatively wide range of electrical potential values. FIG. 6 is demonstrative in this regard, and was generated on the basis of the etch rates shown in FIG. 5. FIG. 6 is a plot of the ratio of coating etch-rate to base metal etch-rate, as a function of electrochemical cell potential. The figure demonstrates that there is a wide plateau of greater than about 400 millivolts, in which selectivity (coating removal over base metal removal) is above 8:1.

The temperature of the electrolyte in solution can be maintained up to about 100° C. In preferred embodiments, the temperature is maintained below about 50C. In some especially preferred embodiments, the temperature range is from about 5C to about 30C.

The stripping time (i.e., the immersion time within the aqueous composition) may vary considerably. Factors which influence the selection of an appropriate time include the composition of the coating being removed; as well as its microstructure, density, and thickness. The electrochemical stripping time may increase with higher density and thicker coatings. Usually, the time will range from about 1 minute to about 36 hours, and preferably, from about 5 minutes to about 8 hours. In some instances, an especially preferred immersion time is in the range of about 10 minutes to about 3 hours.

Figure 2:
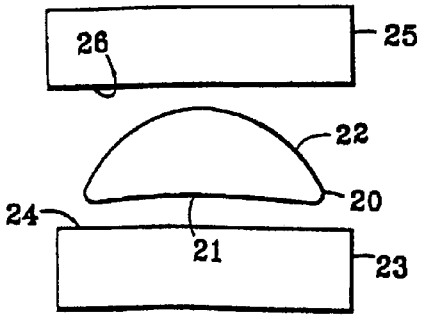
FIG. 2 is a schematic illustration of an exemplary geometrical configuration for a cathode and anode arrangement in an electrochemical stripping system.

FIG. 2 (mentioned previously) and FIG. 3 illustrate two exemplary geometries for the electrodes, as embodied by this invention. These electrode geometries are applicable to stripping a metallic coating from various articles, such as turbine components. However, they are merely exemplary of the geometries within the scope of the invention, and are not meant to limit the invention in any manner.

With the electrode geometry of FIG. 2, an article 20 comprises a configuration with a generally straight side 21 and a convex side 22 (a common shape for a turbine component). An electrode 23 comprises a side 24, which faces side 21. Similarly, an electrode 25 has a side 26 that generally faces side 22 of the article (e.g., side 26 can be parallel to side 24 of electrode 23). In contrast to the prior art, many embodiments of the present invention do not require electrodes that conform to the shape of the part being electrochemically stripped.

Each electrode 23 and 25 is connected to one terminal of the power supply. The article 20 is connected to the other terminal. When current is passed between the electrodes 23 and 25 and the article 20, the surfaces of the article will be electrochemically stripped, as embodied by the invention.

Figure 3:
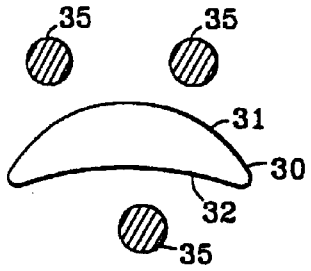
FIG. 3 is a schematic illustration of another exemplary geometrical configuration for a cathode and anode arrangement in an electrochemical stripping system.

The electrode configuration of FIG. 3 comprises an article 30 and a plurality of electrodes 35. Alternatively, multiple components to be stripped can be presented in the stripping system, as embodied by the invention. Article 30 is in the shape of a turbine component, as an example. The article includes a concave surface 31 and a convex surface 32. The electrodes 35 are disposed around the article to provide an approximately uniform electrical field. Each electrode 35 is connected (not shown) to one terminal of the power supply, while the article 30 is connected to the other terminal. When current (at a selected cell potential) is passed between the electrodes 35 and the article 30, the surfaces of the article will be electrochemically stripped.

Figure 7:
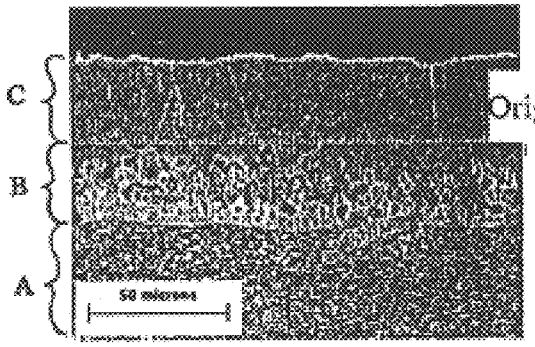
FIG. 7 is a cross-sectional photomicrograph of a platinum aluminide diffusion coating applied over a metal substrate.

As mentioned previously, the present invention is especially useful in a partial stripping operation, e.g., removing individual coating sublayers of aluminum-based diffusion coatings. FIG. 7 is a photomicrograph of a platinum aluminide diffusion coating applied over a superalloy substrate. In this figure, region A is the substrate, while region B generally represents the diffusion sublayer of a platinum aluminide diffusion coating. Region C is the additive sublayer of the diffusion coating. In applying diffusion coatings to a substrate, the additive sublayer causes the substrate (e.g., a turbine wall) to gain thickness. The diffusion sublayer consumes a certain thickness of the wall material.

Figure 8:
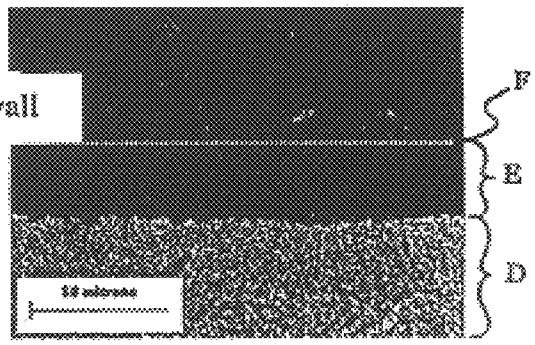
FIG. 8 is a cross-sectional photomicrograph of the coating depicted in FIG. 7, after being treated by a stripping process which removes the entire coating.

FIG. 8 is a photomicrograph of the coated substrate of FIG. 7, after a "full-stripping" treatment according to one embodiment of the present invention. ($H_2SiF_6$ was used as the electrolyte in the electrochemical process described herein). In this figure, region D is the remaining portion of the substrate, while the original surface of the substrate is indicated by dotted line F. (Region E simply depicts the micrograph mounting material and an underlying gap adjacent the current substrate surface).

Thus, in this full-stripping embodiment, both the additive sublayer and the diffusion sublayer are removed. As described herein, the use of the $H_xAF_6$ compound provides considerable advantages for the coating removal process. In many instances, such a process is very suitable, e.g., when there is a need for high stripping rates, or when masking procedures need to be minimized.

However, in other situations, it may be undesirable to remove a significant portion of the substrate, as shown in FIG. 8. This may be the case when the substrate is a wall section of certain turbine engine airfoils, for example. Removal of significant portions of the wall is sometimes (but not always) unacceptable, in view of the required wall thickness specifications.

Thus, the partial-stripping embodiment of this invention is extremely useful for those instances in which the substrate thickness must be preserved during the stripping process. As the examples below demonstrate, use of $H_xAF_6$ in the electrochemical stripping process, under controlled conditions, successfully removes the additive sublayer, while leaving the diffusion sublayer substantially unaffected. The substrate (i.e., the base metal) is also substantially unaffected. Moreover, the process provides an extended period of treatment-exposure time between removal of the additive sublayer and removal of (or damage to) the diffusion sublayer. As mentioned above, the extended time period is an important feature for processing-flexibility on a commercial scale.

The most appropriate range of voltage (cell potential) for partial stripping will depend on many of the factors described previously, in the case of a full strip. As an illustration in the case of a diffusion aluminide-type coating, the voltage should be high enough to remove the additive sublayer, but low enough to avoid significant removal of the diffusion sublayer. Frequently, the selected voltage is in the range of about 0.5 volt to about 0.8 volt. However, this range can be readily adjusted by those skilled in the art, based on empirical results for different stripping conditions.

Figure 9:
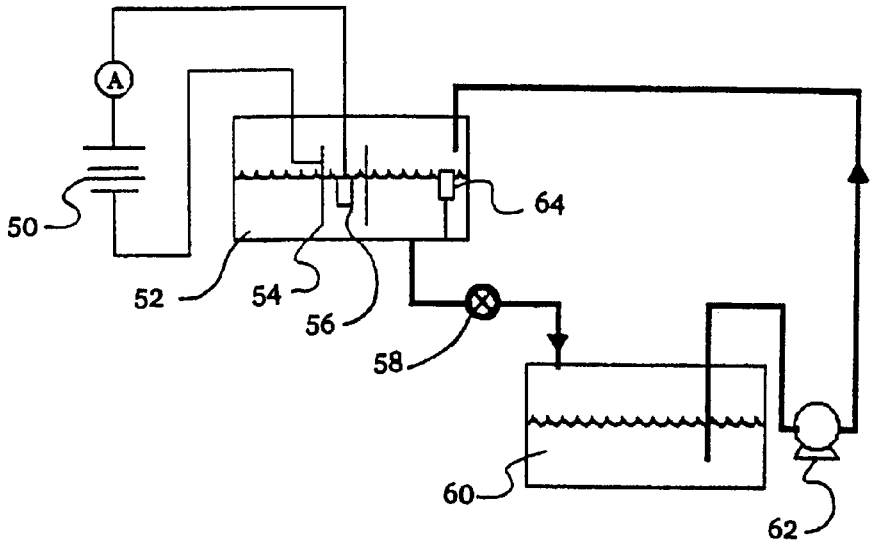
FIG. 9 is a schematic illustration of another electrochemical stripping system suitable for the present invention.

FIG. 9 is a schematic illustration of another electrochemical stripping system which may be used for the present invention. (This type of system may be used to entirely remove various types of coatings, e.g., MCrAl(X)-type coatings, or to remove only the additive sublayer of a diffusion coating.) The stripping system includes power supply 50, which is usually direct current (DC), and which may have pulse capability. Reaction tank 52 holds the electrolyte and the electrodes. Cathode 54 may contain perforations. For example, it may be in the form of a screen, to allow for enhanced solution flow. Alternatively, the cathode can be a solid conductor which may or may not conform to the surface of coated article 56, which is being treated. Control valve 58 continuously drains the tank at a constant rate. Sump tank 60 stores the electrolyte-solution, while pump 62 replenishes the electrolyte to the tank. Level sensor 64 turns the pump on and off, to maintain a consistent level of electrolyte in the reaction tank.

The electrochemical stripping system of FIG. 9 contains features which are very advantageous for some embodiments of the invention. For example, relatively slow, controlled fluid motion occurs in reaction tank 52, as the electrolyte drains from the tank through control valve 58. This fluid motion provides a slight amount of agitation which is helpful in forcing an exchange of reactants and products at the anode and cathode boundary layers. (However, excessive agitation is usually undesirable). Moreover, this type of fluid-recirculating assembly ensures substantial homogeneity of the electrolyte in the reacting tank. The recirculating system also removes precipitates from the reaction tank to the sump tank, from which they can be filtered out of the system.

As mentioned previously, a signal feature of the present invention is the high degree of selectivity it can provide. In other words, the time required to remove a desired coating is much less than the time which elapses before the undesirable removal of an underlying coating or a substrate material. In preferred embodiments, the selectivity (ratio of coating removal to substrate material or underlying material) is greater than about 4:1, and preferably, greater than about 6:1.

Figure 10:
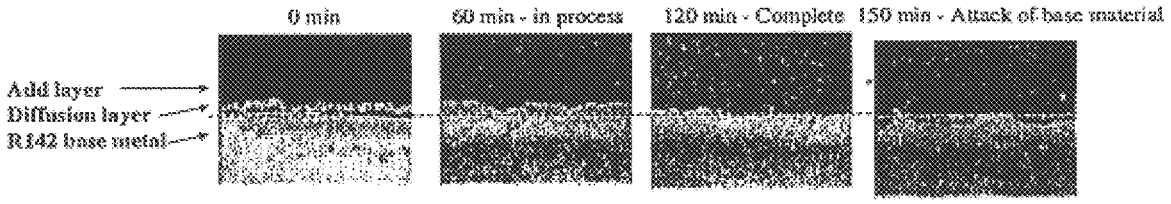
FIG. 10 is a collection of cross-sectional photomicrographs of coating systems treated by a process of the prior art.

The enhanced selectivity is especially (but not exclusively) useful in the case of the diffusion aluminide coatings discussed previously. FIG. 10 demonstrates the results of a prior art stripping process, employing sodium chloride as the electrolyte in an electrochemical stripping system similar to that of FIG. 1. A platinum-aluminide diffusion coating was applied to a substrate formed from a nickel-based superalloy. The additive sublayer and diffusion sublayer are evident in the "0 min" micrograph. It is evident from the figure that complete removal of the additive layer (120 minutes) was followed relatively quickly by attack of the diffusion sublayer and base metal at 150 minutes. Thus, the selectivity in this instance was 150/120, or 1.25. In contrast, the present invention clearly results in much greater selectivity values.

Treatment of the article in the stripping bath according to this invention severely degrades the integrity of the coating being removed. The degraded coating is referred to herein as "smut" or "coating residue". The coating residue (e.g., of a full coating or of an uppermost sublayer of a coating) often continues to weakly adhere to the underlying substrate (or sublayer). Consequently, the treatment is usually followed by a post-stripping step, often referred to as a "de-smutting" operation. Such a step is known in the art, and described in various references. It may be in the form of an abrasion step which minimizes damage to the substrate or the underlying sublayer. As one example, a grit-blasting can be carried out by directing a pressurized air stream containing aluminum oxide particles across the surface. The air pressure is usually less than about 100 psi. The grit-blasting is carried out for a time period sufficient to remove the degraded coating. The duration of grit-blasting in this embodiment will depend on various factors, such as the thickness and specific composition of the smut layer; the size and type of grit media, and the like. The process is typically carried out for about 30 seconds to about 3 minutes.

Other known techniques for abrading the surface may be used in lieu of grit-blasting. Many of these are described in U.S. Pat. No. 5,976,265, incorporated herein by reference. For example, the surface can be manually scrubbed with a fiber pad, e.g. a pad with polymeric, metallic, or ceramic fibers. Alternatively, the surface can be polished with a flexible wheel or belt in which alumina or silicon carbide particles have been embedded. Liquid abrasive materials may alternatively be used on the wheels or belts. These alternative techniques would be controlled in a manner that maintained a contact force against the surface that was no greater than the force used in the grit-blasting technique discussed above.

Other techniques (or combinations of techniques) could be employed in place of abrasion, to remove the degraded material. Examples include tumbling of the article (e.g., water-tumbling), or laser ablation of its surface. Alternatively, the degraded material could be scraped off the surface. As still another alternative, sound waves (e.g., ultrasonic) could be directed against the surface, causing vibrations which can shake loose the degraded material. For each of these alternative techniques, those skilled in the art would be familiar with operating adjustments which are made to control the relevant force applied against the surface of the article (as in the case of the abrasion technique), to minimize damage to the substrate or coating sublayer being preserved. The article is sometimes rinsed after this step, e.g., using water or a combination of water and a wetting agent.

As mentioned above, another embodiment of this invention relates to a method for replacing a worn or damaged protective coating applied over a substrate. The first step of this embodiment is the electrochemical removal of the coating by the process described above. In other words, the substrate is immersed in an aqueous composition through which electrical current flows, wherein the aqueous composition comprises the $H_xAF_6$ compound, or suitable precursors. The electrochemical treatment is usually followed by de-smutting and rinsing steps, as discussed previously.

The replacement coating can then be applied to the substrate. Examples of coatings to be applied include the diffusion aluminide or MCrAlX-type coatings, or wear coatings. They are applied to the surface by conventional techniques, such as aluminiding processes (e.g., pack aluminiding), HVOF, plasma spray (e.g., air plasma spray), physical vapor deposition, and the like. Those skilled in the art are aware of other aspects of the coating process, e.g., cleaning and/or surface roughening steps, when appropriate.

This replacement process is especially useful in the case of diffusion aluminide coatings. As described previously, repeated stripping and re-applications of such coatings can undesirably decrease the thickness of the substrate, e.g., a turbine airfoil. However, when a partial stripping process is carried out according to this invention, the additive sublayer of such a coating can be repeatedly removed and replaced, without substantially affecting the underlying diffusion sublayer. Thus, the specified wall thickness of the airfoil can be maintained for a greater service period. This advantage is an important feature in a commercial setting, where component replacement or repair can be a time-consuming and expensive undertaking.

EXAMPLES

The following examples are merely illustrative, and should not be construed to be any sort of limitation on the scope of the claimed invention. In each instance of coating removal, the stripping step was followed by a de-smutting step, as described above. Usually, de-smutting consisted of grit-blasting, followed by air-blowing of the surface.

Example 1A coupon formed from a nickel-base superalloy was used in this example.

A platinum layer having a thickness of about 5 microns was electroplated onto the superalloy surface. The coated surface was then diffusion-aluminided to a depth of about 75 microns. The coupon was then heat-treated at 2050F (1121C) for 47 hours, in order to simulate a service environment. The coated coupon was then treated according to an embodiment of this invention, to determine the effect of the treatment over a preselected time period.

Treatment was carried out by using an electrochemical stripping system similar to that depicted in FIG. 1. The distance from the cathode to the anode in the stripping apparatus was about 1 inch (2.54 cm). 10% $H_2SiF_6$ (by weight) in water was used as the electrolyte. The stripping bath was maintained at room temperature. A voltage (cell potential) of 1.1 volts with a pulsed wave form of 400 msec "on" and 10 msec "off" was applied to the electrochemical cell.

Figure 11:
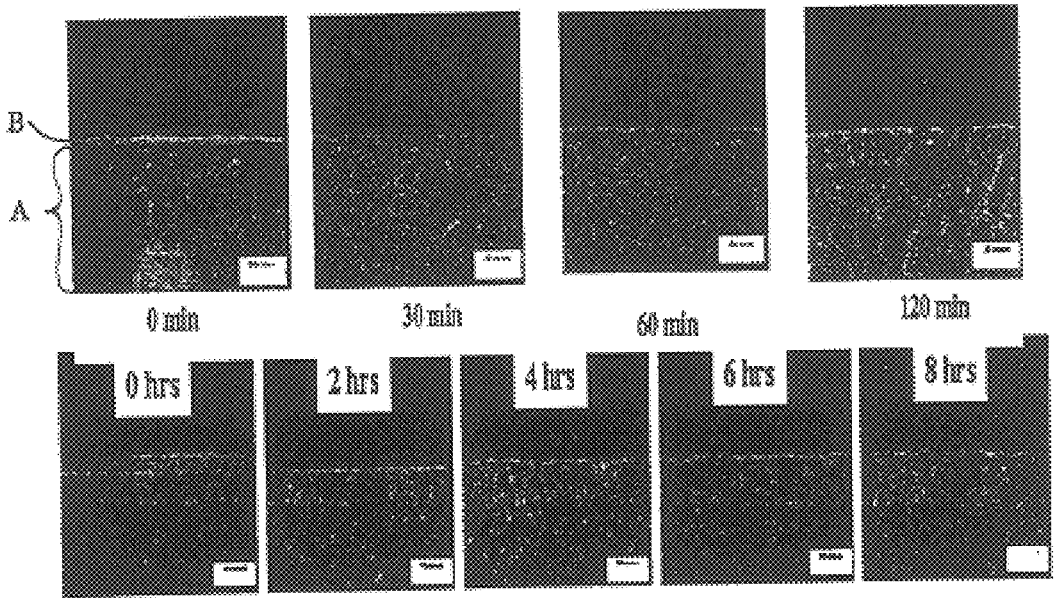
FIG. 11 is a collection of cross-sectional photomicrographs showing treatment of coating systems by the present invention, at timed intervals.

FIG. 11 is a series of micrographs which depict treated sections of the coupons, over the indicated time periods. The top four micrographs (0 min, 30 min, 60 min, and 120 min) were taken of one coated coupon, while the other five micrographs (0 hrs, 2 hrs, 4 hrs, 6 hrs, and 8 hrs) were taken of another coated coupon. In the first photograph ("0 min"), section A is the base metal, and section B is the platinum/diffusion-aluminide coating.

The micrographs show substantially-complete removal of the coating after about 30 minutes. Moreover, the base metal was not significantly damaged after the coating had been removed, even after a total exposure time of 8 hours. There were no deep pits (e.g., greater than about 10 microns in depth) or grain boundary etches in the substrate surface. Furthermore, an insignificant amount of base metal was lost in the process, and the loss was relatively uniform.

Example 21n this experiment, aluminide coatings were removed from the exterior surface of actual turbine blades which had been taken out of service (i.e., extended and periodic exposure to temperatures greater than about 900–1000C). An electrochemical cell was constructed, using the turbine blade as the anode, and a copper mesh as the cathode. The same electrolyte that was used in Example 1 was used here, i.e., 10% $H_2SiF_6$ in water. A cell potential of 1.1 volts with a pulsed wave form was applied (as in Example 1), for 45 minutes.

Figures 12, 13:
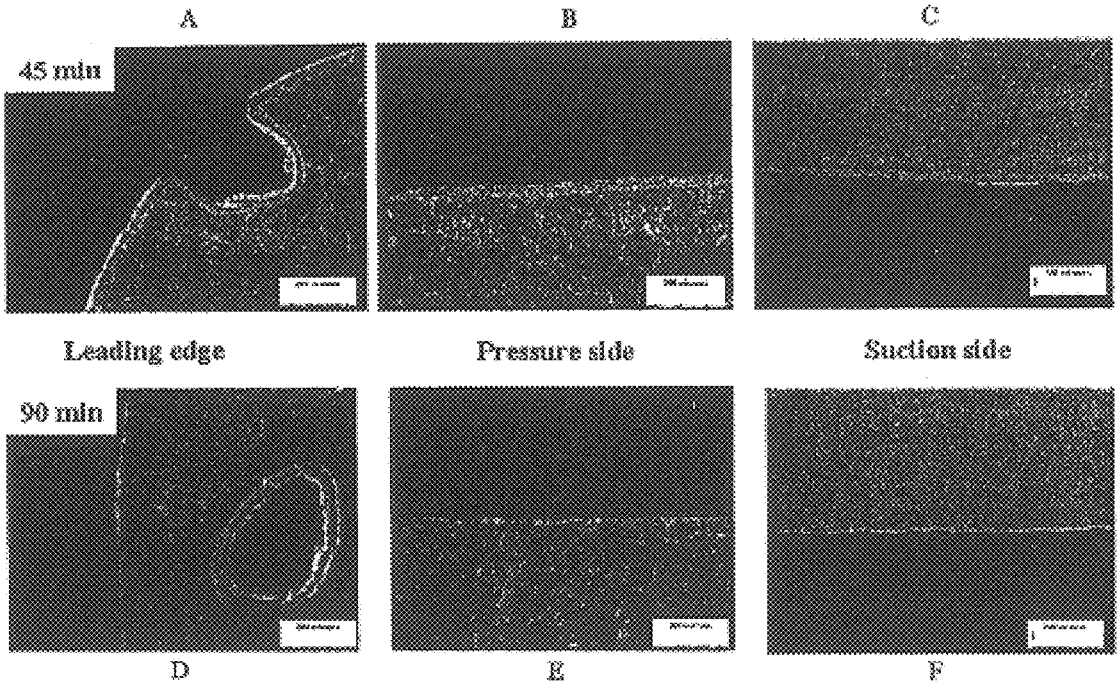
FIG. 12 is a set of cross-sectional photomicrographs of different sections of a coated turbine blade treated according to the present invention.
FIG. 13 is another set of cross-sectional photomicrographs of sections of another coated turbine blade treated according to this invention.

The micrographs shown in FIG. 12 depict regions of the turbine blade taken at the 80% span section for the leading edge, pressure side, and suction side of the blade. Micrographs A, B and C depict the blade sections after 45 minutes immersion in the treatment solution.

It is clear from the figure that most of the coating had been removed from the turbine blades after 45 minutes of exposure to the treatment solution. A relatively small volume of the diffusion layer that formed between the aluminide and the base metal remained.

Example 3A turbine blade similar to that of Example 2 was exposed to the same electrochemical process. However, the exposure time (i.e., immersion time in the treatment solution) was 90 minutes. The blade sections taken at the 80% span section for the leading edge, pressure side, and suction side of the blade are depicted in micrographs D, E and F of FIG. 13.

It is clear from FIG. 13 that after 90 minutes of exposure, the aluminide coating was completely removed. Moreover, the base metal did not show any sign of material loss. Furthermore, the coating material on the interior hole in the leading edge section was not removed. This is an important attribute because it demonstrates that internal masking of the hole is not required when the present process is followed. This attribute extends to any internal region or cavity in an article, e.g., indentations, hollow regions, or holes. In the case of a turbine airfoil, the internal region is often in the form of radial cooling holes or serpentine passageways, as mentioned previously.

The blade for this example was also subjected to "heat tinting". In such a treatment, the blade is heated to 600C in ambient air, in order to grow a thermal oxide on the surface. The thermal oxide that forms on the nickel alloy is bluish-brown, while that which forms on the aluminide material is light tan. After heat-tinting, the entire exterior surface was bluish-brown, indicating that there was no aluminide coating on the exterior surface. Thus, the fillets at the base (i.e., the dovetail) of the turbine blade were also free of aluminide material. Since such a region is somewhat recessed within the planar surface of the blade, it is usually difficult to obtain uniform voltage distribution and, consequently, adequate coating removal. However, the presently-described stripping process successfully removed the coating from this region.

Example 4A coupon of a nickel-based superalloy was coated with a platinum-aluminide diffusion coating, to an overall thickness of about 75 microns. The coated coupon was heat-treated at 2075F (1135C) for about 47 hours, to simulate an engine-run coating. The coupon was divided into five sections, each individually masked. Each section was exposed to the electrochemical stripping process for different time periods, by removing a selected mask at a different exposure time. An electrical cell potential of 1.1 V was used in the stripping bath, with a pulsed wave form of 400 ms "on" and 10 ms "off". The cathode was a flat copper screen held 1 inch (2.54 cm) away from the coupon. The electrolyte was a 10% solution of $H_2SiF_6$ in water.

Figure 14:
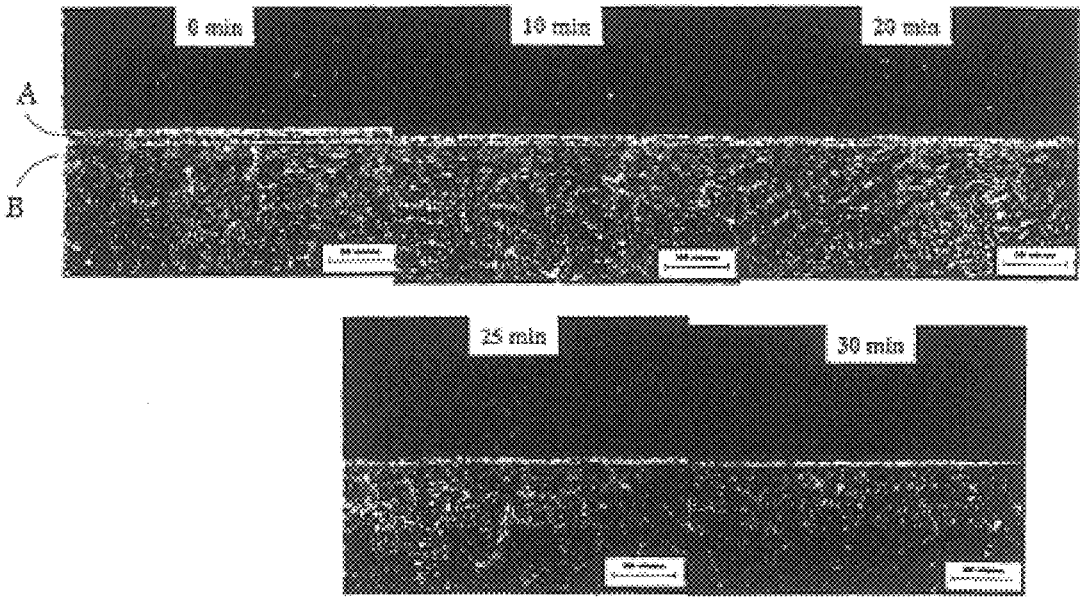
FIG. 14 is a set of cross-sectional photomicrographs of a coated article which has been subjected to a partial stripping process according to the present invention.

Micrographs from each of the coupon sections are depicted in FIG. 14. As described above, this type of diffusion coating includes an additive sublayer and a diffusion sublayer (regions "A" and "B", respectively, in the "0 min" micrograph of FIG. 14). The additive sublayer had a thickness of about 37.5 microns, while the diffusion sublayer had a thickness of about 37.5 microns.

After 10 minutes of exposure in the stripping bath, the additive sublayer was completely removed. During an additional 10 minutes of exposure, the diffusion sublayer was substantially unaffected. These respective time periods demonstrate a large processing window for "partially stripping" a coating by way of time-control. After 30 minutes, the diffusion sublayer was almost completely removed.

Figure 15:
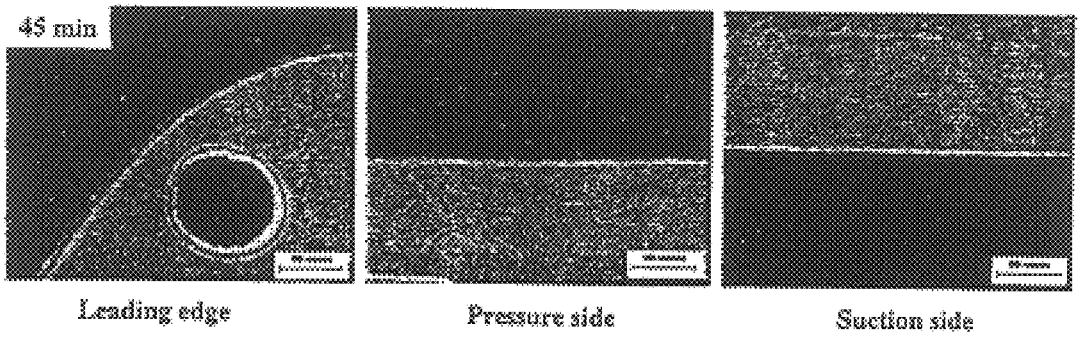
FIG. 15 is a set of cross-sectional photomicrographs of sections of a coated turbine blade subjected to a partial stripping process according to this invention.

Example 5A turbine airfoil blade which had been in service for at least about 1000 hours was stripped, using the presently-described process. The stripping bath conditions were similar to that of Example 4, except that the electrical potential was 0.7 volt, and the stripping duration was 45 minutes. FIG. 15 depicts blade sections taken of the leading edge, the pressure-side, and the suction side, at the 80% span. In each micrograph, the aluminide coatings (additive layer) are white; the diffusion zone is dark gray; and the base metal is light gray.

Each micrograph shows that the entire additive layer had been removed from the airfoil. The aluminide in the inner cooling channels had not been removed, which was intentional. (There is no electric field or current in the internal cavities of the blade, so no substantial etching took place in those regions.) As noted above, this is advantageous because it generally obviates the task of masking those internal regions.

The optimized conditions for removal of coatings from an actual turbine blade are slightly different from those maintained when removing coatings from coupons. This difference is due in part to the effects of part geometry and varying thermal histories for the components. Those skilled in the art can determine the most appropriate set of conditions for a particular component and coating, based on the teachings herein. A plot of charge transfer-versus-time can be used to determine when the additive sublayer of a diffusion coating has been completely removed.

Figure 16:
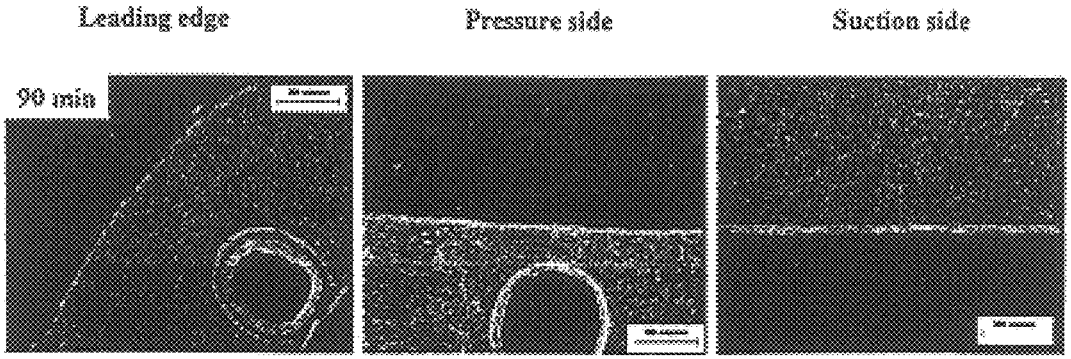
FIG. 16 is a set of cross-sectional photomicrographs of another coated turbine blade which was partially stripped, for a time period longer than that used for the blade of FIG. 15.

Example 6 Another turbine blade was stripped under conditions similar to those used in Example 5, using the $H_2SiF_6$ electrolyte. However, in this example, the exposure time was 90 minutes, rather than 45 minutes. FIG. 16 depicts blade sections like those of FIG. 15. Once again, the aluminide on the inner cavities has not been substantially attacked. The diffusion region is still generally intact, although it has less mass than in the case of the 45 minute-treatment. The example again confirms the finding that a large exposure-time "window" is present in this process, when processing conditions like voltage, electrode geometry, and agitation are adjusted.

While various embodiments are described herein, it will be appreciated from the specification that various combinations of elements, variations or improvements therein may be made by those skilled in the art, and are within the scope of the invention.

What is claimed is:

1. An electrochemical stripping method for selectively removing at least one coating from the surface of a substrate, comprising the step of immersing the substrate in an aqueous composition through which electrical current flows, wherein the composition comprises an acid having the formula $H_xAF_6$, or precursors to said acid, wherein A is selected from the group consisting of Si, Ge, Ti, Zr, Al, and Ga; and x is 1–6.

2. The method of claim 1, wherein x is 1–3.

3. The method of claim 1, wherein the acid is present at a level in the range of about 0.05 M to about 5 M.

4. The method of claim 3, wherein the acid is present at a level in the range of about 0.2 M to about 3.5 M.

5. The method of claim 1, wherein the precursor is a salt of the acid.

6. The method of claim 1, wherein the aqueous composition comprises the compound $H_2SiF_6$ or $H_2ZrF_6$.

7. The method of claim 6, wherein the $H_2SiF_6$ compound is formed in situ within the aqueous composition, by the dissociation of a corresponding salt of the compound; or by the reaction of a silicon-containing compound with a fluorine-containing compound.

8. The method of claim 7, wherein the silicon-containing compound is $SiO_2$, and the fluorine-containing compound is HF.

9. The method of claim 1, wherein the aqueous composition is maintained at a temperature not greater than about 100C.

10. The method of claim 9, wherein the aqueous composition is maintained at a temperature below about 50C.

11. The method of claim 1, wherein the aqueous composition further comprises at least one additive selected from the group consisting of inhibitors, dispersants, surfactants, chelating agents, wetting agents, deflocculants, stabilizers, anti-settling agents, and anti-foam agents.

12. The method of claim 1, wherein the coating being removed from the substrate comprises at least one diffusion coating or overlay coating.

13. The method of claim 12, wherein the diffusion coating comprises an aluminide material.

14. The method of claim 13, wherein the aluminide material is selected from the group consisting of aluminide, noble metal-aluminide, nickel-aluminide, noble metal-nickel-aluminide, and mixtures thereof.

15. The method of claim 12, wherein the overlay coating comprises MCrAl(X), where M is an element selected from the group consisting of Ni, Co, Fe, and combinations thereof, and X is an element selected from the group consisting of Y, Ta, Si, Hf, Ti, Zr, B, C, and combinations thereof.

16. The method of claim 1, wherein the substrate comprises a metallic material.

17. The method of claim 16, wherein the metallic material comprises at least one element selected from the group consisting of iron, cobalt, nickel, aluminum, chromium, titanium, and mixtures which include any of the foregoing.

18. The method of claim 16, wherein the metallic material comprises a superalloy.

19. The method of claim 18, wherein the superalloy is nickel-based or cobalt-based.

20. The method of claim 18, wherein the superalloy is a component of a turbine engine.

21. The stripping method of claim 1, wherein the substrate is an article containing internal regions covered by at least one coating, wherein the coatings covering the internal regions are not substantially affected.

22. The method of claim 1, wherein the coating is a diffusion coating or overlay coating; the substrate is metallic, and immersion of the substrate in the aqueous composition removes the coating but does not remove a substantial portion of the substrate.

23. The method of claim 1, wherein the substrate is immersed in the aqueous composition for a time period in the range of about 1 minute to about 36 hours.

24. The method of claim 23, wherein the time period of immersion is in the range of about 5 minutes to about 8 hours.

25. The method of claim 1, wherein the aqueous composition is stirred or agitated while the substrate is immersed therein.

26. The method of claim 1, further comprising the step of removing coating residue after treatment in the aqueous composition.

27. The method of claim 26, wherein the coating residue is removed by at least one technique selected from the group consisting of abrasion, tumbling, laser ablation, and ultrasonic agitation.

28. The method of claim 27, wherein the abrasion is carried out by a grit-blasting technique.

29. The method of claim 1, wherein the coating being removed is an additive sublayer of an aluminum-based diffusion coating.

30. The method of claim 29, wherein the aluminum-based diffusion coating also comprises a diffusion sublayer beneath the additive sublayer, and the diffusion sublayer is not removed during removal of the additive sublayer.

31. An electrochemical stripping method for selectively removing at least one diffusion coating or overlay coating from the surface of a superalloy substrate, comprising the following steps:

(a) disposing the substrate and at least one electrode in a solution comprising an electrolyte which comprises an acid having the formula $H_xAF_6$, or precursors to said acid, wherein A is selected from the group consisting of Si, Ge, Ti, Zr, Al, and Ga; and x is 1–6;

(b) applying electrical current from a power source, between the electrode and the substrate; and (c) removing the coating without substantially consuming or degrading the superalloy substrate.

32. The method of claim 31, wherein at least two electrodes are disposed in the solution, and the substrate is positioned between the electrodes.

33. The method of claim 31, wherein a plurality of electrodes are disposed in the solution, to at least partially surround the substrate, wherein the electrical current is applied to the substrate and each electrode, resulting in an electrochemical reaction between the electrolyte and the coating on the substrate.

34. An electrochemical method for partially stripping a coating from the surface of a substrate, wherein the coating comprises an upper sublayer and a lower sublayer, said method comprising the step of immersing the substrate in an aqueous composition which comprises an acid having the formula $H_xAF_6$, or precursors to said acid, wherein A is selected from the group consisting of Si, Ge, Ti, Zr, Al, and Ga, and x is 1–6; and wherein the aqueous composition is subjected to a controlled electrical cell potential sufficient to remove the upper sublayer without substantially removing the lower sublayer.

35. The method of claim 34, wherein the substrate comprises a superalloy.

36. The method of claim 34, wherein the coating is a diffusion aluminide coating; the upper sublayer is an additive sublayer; and the lower sublayer is a diffusion sublayer.

37. The method of claim 34, wherein the aqueous composition comprises the compound $H_2SiF_6$ or $H_2ZrF_6$.

38. A method for replacing a worn or damaged protective coating applied over a substrate, comprising the following steps:

(i) electrochemically removing the worn or damaged coating by immersing the substrate in an aqueous composition through which electrical current flows, wherein the aqueous composition comprises an acid having the formula $H_xAF_6$, or precursors to said acid, wherein A is selected from the group consisting of Si, Ge, Ti, Zr, Al, and Ga, and x is 1–6; and then (ii) applying a new coating over the substrate.

39. The method of claim 38, wherein the worn or damaged protective coating is a diffusion aluminide coating or an overlay coating.

40. The method of claim 39, wherein the diffusion aluminide coating comprises a diffusion sublayer over the substrate and an additive sublayer over the diffusion sublayer; and the additive sublayer is removed while the diffusion sublayer is substantially unaffected.

41. An apparatus for the electrochemical removal of at least one coating from a substrate, comprising:

(a) an electrolyte which comprises an acid having the formula $H_xAF_6$, or precursors to said acid, wherein A is selected from the group consisting of Si, Ge, Ti, Zr, Al, and Ga; and x is 1–6;

(b) an electrical current source capable of being connected to the coated substrate and an electrode; and (c) at least one electrode from which the electrical current source can apply electrical current through the electrolyte to the coated substrate.

42. The apparatus of claim 41, wherein the substrate is a turbine component.

43. The apparatus of claim 41, wherein component (c) comprises a plurality of electrodes disposed in a configuration that substantially surrounds the coated substrate.

44. The apparatus of claim 41, wherein the electrical current source is a direct current (DC) source having pulse capability.

45. The apparatus of claim 41, further comprising a device capable of stirring and agitating the electrolyte.

46. The apparatus of claim 41, wherein the electrolyte is incorporated into a stripping bath in which the coated substrate can be immersed.

* * * * *